US006927657B1

(12) United States Patent
Wu

(10) Patent No.: US 6,927,657 B1
(45) Date of Patent: Aug. 9, 2005

(54) MAGNETIC POLE LAYOUT METHOD AND A MAGNETIZING DEVICE FOR DOUBLE-WING OPPOSITE ATTRACTION SOFT MAGNET AND A PRODUCT THEREOF

(76) Inventor: Michael Wu, 1F, No.16, Yu-Jen Rd., Pei-Tou Dist., Taipei (TW)

( * ) Notice: Subject to any disclaimer, the term of this patent is extended or adjusted under 35 U.S.C. 154(b) by 0 days.

(21) Appl. No.: 11/014,169

(22) Filed: Dec. 17, 2004

(51) Int. Cl.[7] ..... H01F 7/20

(52) U.S. Cl. ..... 335/284; 335/285; 335/302; 335/303; 335/306; 24/303

(58) Field of Search ..... 335/284, 285, 335/302–306; 281/42; 24/303; 116/234

(56) References Cited

U.S. PATENT DOCUMENTS 2,448,611 A * 9/1948 Martin ..... 116/234
3,529,328 A * 9/1970 Davison ..... 24/303
3,629,905 A * 12/1971 Cote ..... 24/30.5 R
3,924,631 A * 12/1975 Mancusi, Jr. ..... 600/30
4,222,489 A * 9/1980 Hutter ..... 211/45
4,255,837 A * 3/1981 Holtz ..... 24/303
4,258,493 A * 3/1981 Kettlestrings et al. ..... 40/600
4,941,236 A * 7/1990 Sherman et al. ..... 24/303
5,103,756 A * 4/1992 Korkames ..... 116/234
5,425,160 A * 6/1995 Krapf ..... 24/67 R
5,682,653 A * 11/1997 Berglof et al. ..... 24/303
6,401,649 B1 * 6/2002 Smith ..... 116/234

* cited by examiner

*Primary Examiner*—Ramon M. Barrera
(74) *Attorney, Agent, or Firm*—Troxell Law Office, PLLC

(57) ABSTRACT

A magnetic pole layout method and a magnetizing device for double-wing opposite-attraction soft magnet. A magnetizing conductor is wound on a magnetic conductive tray. A pulse power is fed to the magnetizing conductor to multiple pairs of corresponding first and second magnetizing regions. A magnetizable soft plate is placed on the magnetic conductive tray and magnetized at one time to form multiple pairs of reverse magnetic poles. The magnetized soft plate is then cut into elongated magnet slat in the direction of the formed magnetic poles and then the magnet slat is oppositely folded about a folding line to form a double-wing opposite-attraction soft magnet. The double-wing opposite-attraction soft magnet can ride on a page of a book or a paper along the folding line to clip the page and serve as a bookmark.

19 Claims, 8 Drawing Sheets

MAGNETIC POLE LAYOUT METHOD AND A MAGNETIZING DEVICE FOR DOUBLE-WING OPPOSITE ATTRACTION SOFT MAGNET AND A PRODUCT THEREOF

BACKGROUND OF THE INVENTION

The present invention is related to a magnetic pole layout method and a magnetizing device for double-wing opposite-attraction soft magnet and a product thereof. By means of the method and device, a large-area magnetizable soft plate can be placed on a magnetic conductive tray and magnetized at one time to form multiple pairs of reverse magnetic poles. The magnetized soft plate is then cut into multiple elongated magnet slats which can be folded to form double-wing opposite-attraction soft magnets.

In the conventional magnetic pole layout method and magnetizing device for soft magnet, a pulse power is fed to an inducing coil of a magnetic conductive tray to form magnetizing regions with multiple sets of magnetic poles on single face. That is, by means of one type of magnetic pole layout measure, the magnetizable soft plate can be magnetized to form multiple sets of magnetic poles on one face.

FIG. 5 shows a large-area soft magnet sheet which is made with multiple magnetic poles on one face by the above magnetizing method. Two such soft magnet sheets 61, 62 with reverse magnetic poles attract and overlap each other. One end of the soft magnet sheet is pressed and fused with one end of the other soft magnet sheet by high-frequency wave 63. Then the soft magnet sheets 61, 62 are cut into elongated double-slat opposite-attraction clips 60 in the direction of the magnetic poles. According to such measure, the magnetic poles of the two slats must be accurately aligned with each other. Otherwise, the attraction and clipping force will be affected. However, error is often caused by human factors so that the ratio of defective products is high. Moreover, it is relatively difficult to process the products and the manufacturing cost is relatively high.

The above double-slat opposite attraction soft magnet has been widely applied to various fields. For example, such double-slat opposite attraction soft magnet can be used as a bookmark for firmly clipping a page of a book without easily dropping. A metal bookmark with clipping effect has been developed. However, such metal bookmark has relatively complicated structure and is manufactured at higher cost. Furthermore, such metal bookmark tends to damage the pages of the book.

SUMMARY OF THE INVENTION

It is therefore a primary object of the present invention to provide a magnetic pole layout method and a magnetizing device for double-wing opposite-attraction soft magnet. By means of the method and device, a large-area magnetizable soft plate can be magnetized at one time to form multiple pairs of reverse magnetic poles. The magnetized soft plate is then cut into multiple elongated magnet slats which can be folded to form double-wing opposite-attraction soft magnets. According to the above method, the production amount can be increased and the manufacturing cost can be lowered.

It is a further object of the present invention to provide a double-wing opposite-attraction soft magnet which can attractively fixedly clip a page of a book. Therefore, a user can easily find the position of the marked page.

According to the above objects, the magnetic pole layout method for double-wing opposite-attraction soft magnet of the present invention includes steps of:

(a) preparing a magnetic conductive tray having multiple tidily arranged longitudinal guide channels and oblique guide channels for defining as at least one pair of corresponding first magnetizing region and second magnetizing region;

(b) sequentially winding a magnetizing conductor on the corresponding first magnetizing region and second magnetizing region along the longitudinal guide channels and the oblique guide channels, after sequentially winding the magnetizing conductor on the corresponding magnetizing regions along the longitudinal guide channels and the oblique guide channels, the guide channels being flush filled with bakelite powder or other insulating material to form a plane on the magnetic conductive tray;

(c) horizontally placing a magnetizable soft plate on the magnetic conductive tray;

(d) feeding a pulse current to the first magnetizing region and second magnetizing region for simultaneously magnetizing the magnetizable soft plate and forming multiple pairs of corresponding reverse magnetic poles on the magnetizable soft plate; and (e) cutting the magnetized soft plate into elongated slat in the direction of the formed magnetic poles and then transversely folding the elongated slat about a section adjoining the first and second magnetizing regions to form the double-wing opposite-attraction soft magnet.

Still according to the above objects, the double-wing opposite-attraction soft magnet plate of the present invention includes a soft magnet slat having two foldable wings interconnected by a folding line. The two wings have opposite reverse magnetic poles, whereby the wings can be oppositely folded to attract each other for clipping a page of a book or a paper.

In the above double-wing opposite-attraction soft magnet plate, one of the wings is cut with a projecting extension tab near the folding line for a user to easily take.

The present invention can be best understood through the following description and accompanying drawings wherein:

BRIEF DESCRIPTION OF THE DRAWINGS

FIG. 4-1 is a plane view of the product of the double-wing opposite attraction soft magnet of the present invention in one aspect;

FIG. 4-2 is a plane view of the product of the double-wing opposite attraction soft magnet of the present invention in another aspect;

FIG. 4-3 is a perspective view of the product of the double-wing opposite attraction soft magnet of the present invention according to FIG. 4-2;

DETAILED DESCRIPTION OF THE PREFERRED EMBODIMENTS

Figure 1:
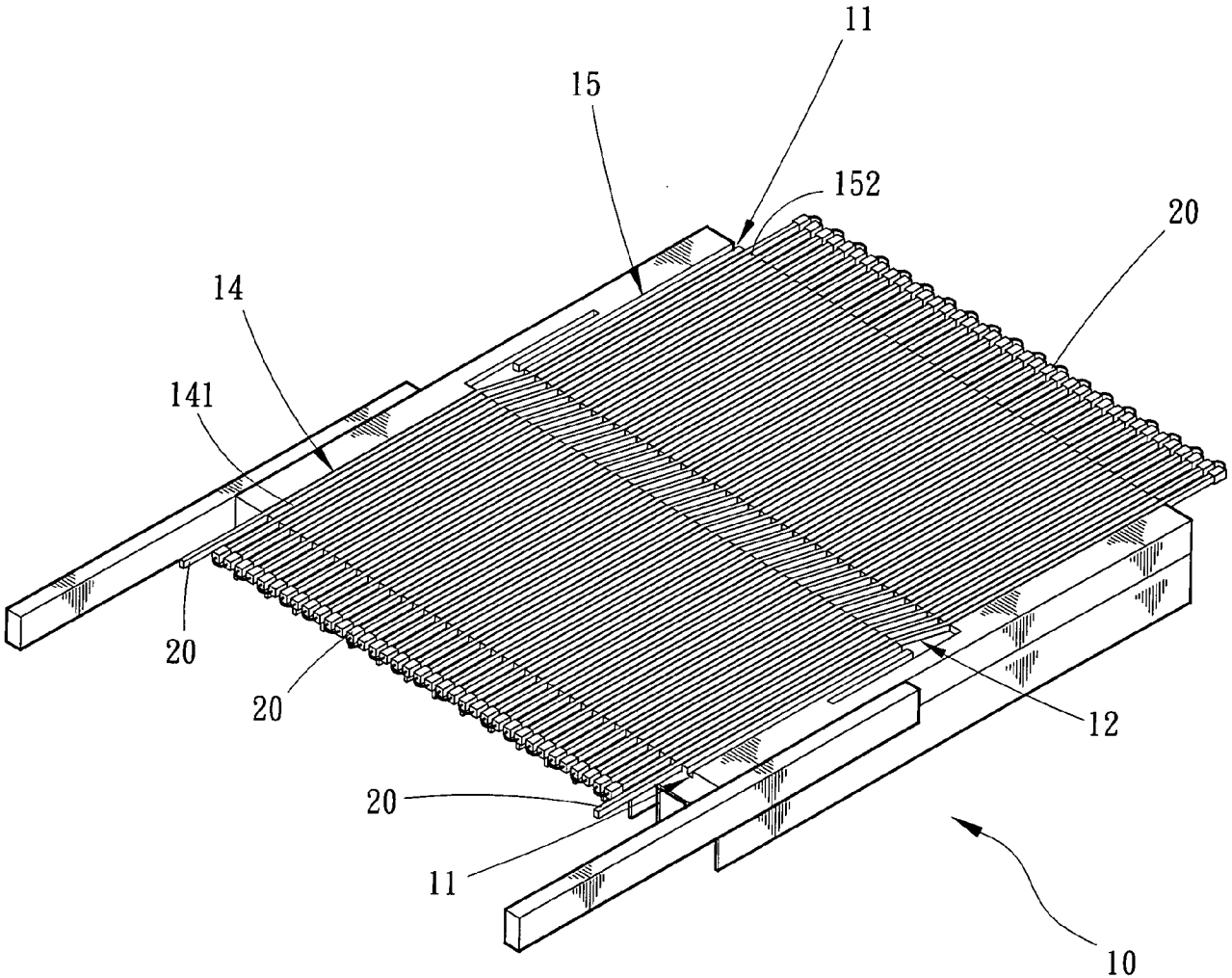
FIG. 1 is a perspective view showing the magnetic pole layout method and the magnetizing device for the double-wing opposite attraction soft magnet of the present invention.
Figure 2:
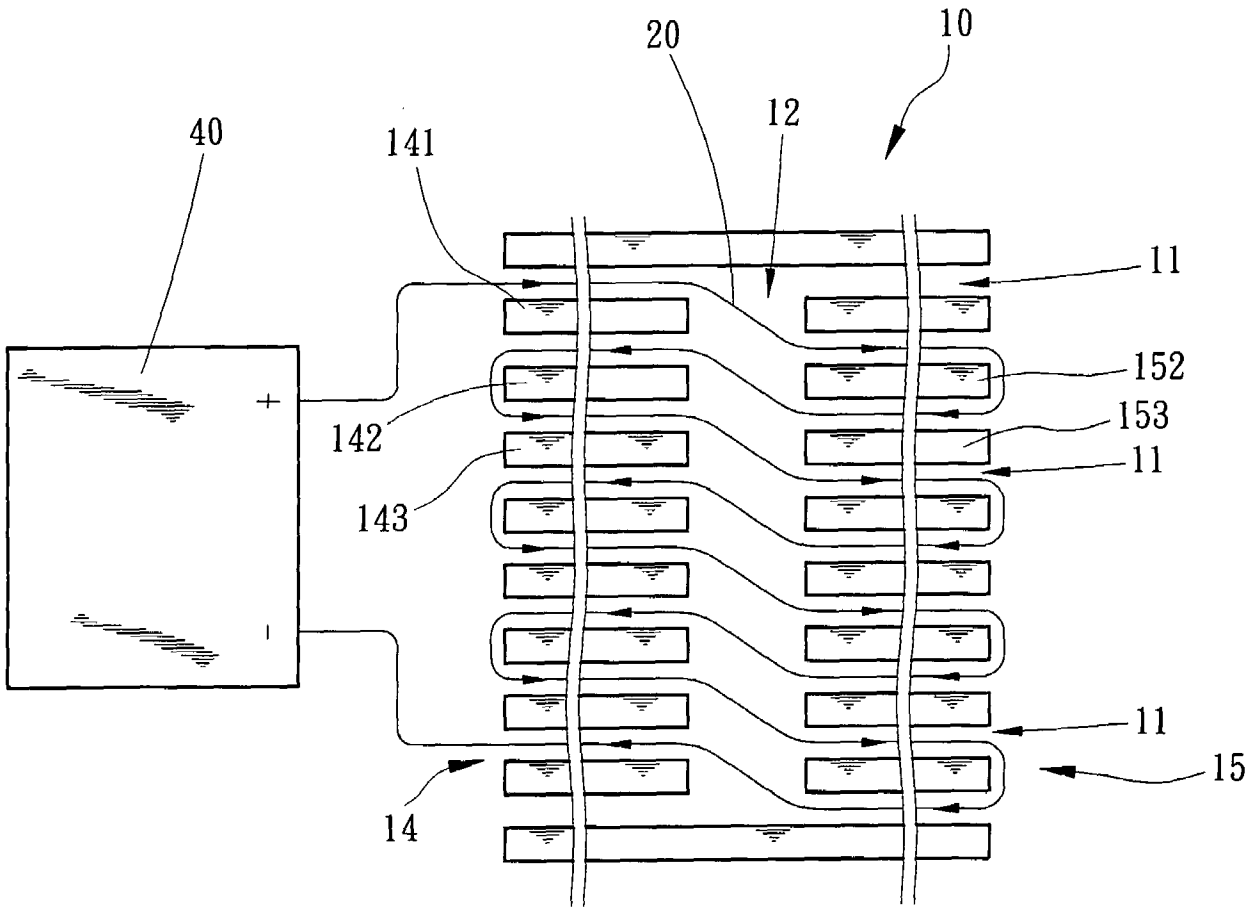
FIG. 2 is a top view according to FIG. 2, showing the magnetic pole layout method and the magnetizing device for the double-wing opposite attraction soft magnet of the present invention.
Figure 3:
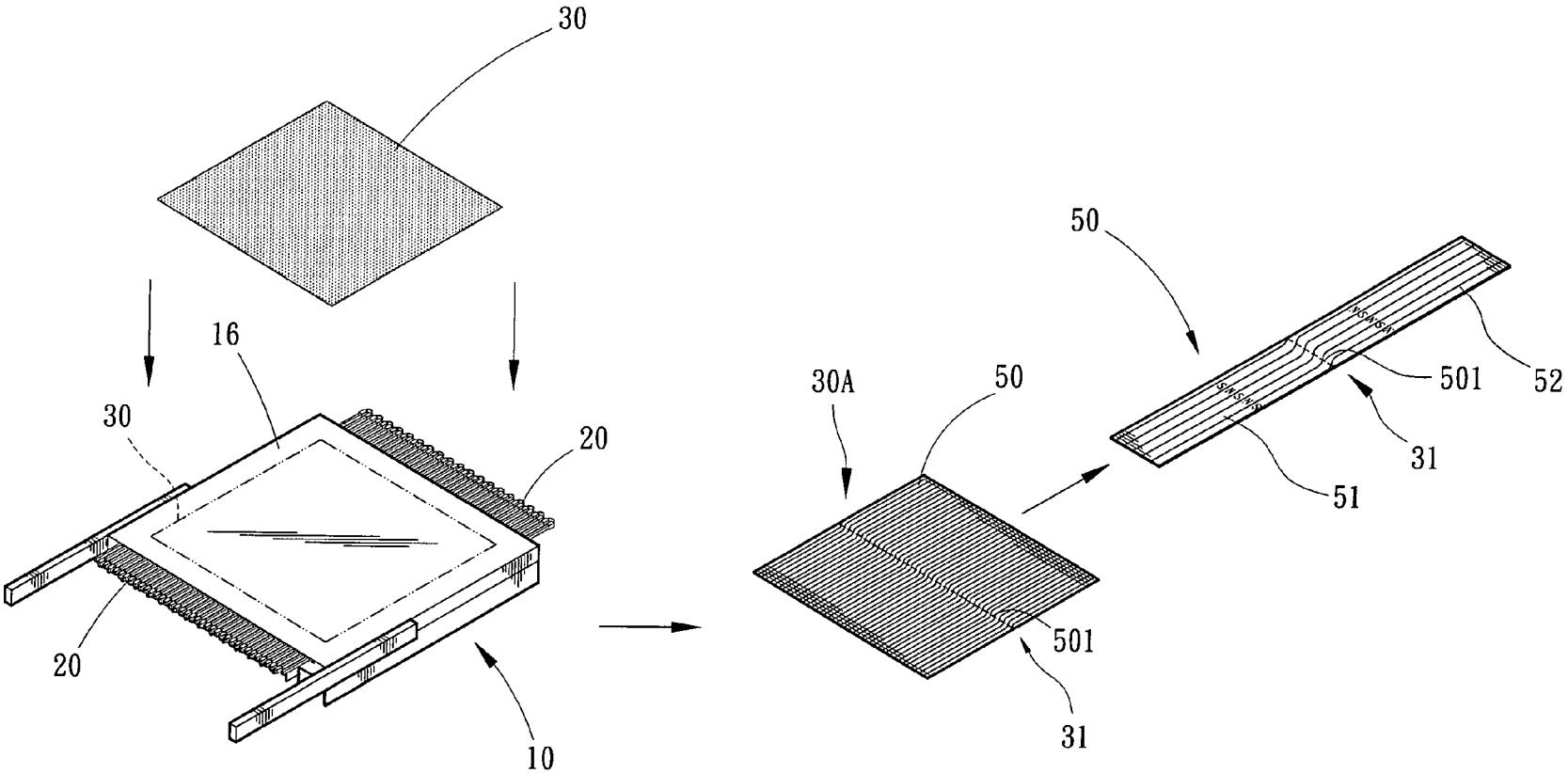
FIG. 3 is a perspective view showing the manufacturing procedure of the present invention.

Please refer to FIGS. 1 to 3. The magnetic pole layout method for double-wing opposite-attraction soft magnet of the present invention includes steps of:

(a) preparing a magnetic conductive tray 10 having multiple tidily arranged longitudinal guide channels 11 and middle oblique guide channels 12 deviated by one pitch, two ends of the magnetic conductive tray 10 being respectively defined as at least one pair of first magnetizing region 14 and second magnetizing region 15 with reverse magnetic poles, the gap between two adjacent longitudinal guide channels 11 being equal to the width of the spacer projecting blocks between the longitudinal guide channels 11;

(b) sequentially winding a magnetizing conductor 20 on the corresponding first magnetizing region 14 and second magnetizing region 15 along the longitudinal guide channels 11 and the oblique guide channels 12;

(c) horizontally placing a magnetizable soft plate 30 on the magnetic conductive tray 10;

(d) feeding a high-voltage pulse power 40 to form reverse magnetic poles on the first magnetizing region 14 and second magnetizing region 15 for simultaneously magnetizing the magnetizable soft plate 30; and (e) cutting the magnetized soft plate 30 into elongated slat in the direction of the formed magnetic poles and then transversely folding the elongated slat about a section magnetized by the oblique guide channels 12 to form the double-wing opposite-attraction soft magnet 50.

Referring to FIG. 2, after sequentially winding the magnetizing conductor 20 on the corresponding first magnetizing region 14 and second magnetizing region 15 along the longitudinal guide channels 11 and the oblique guide channels 12, the guide channels are flush filled with bakelite powder or other insulating material to form a plane on the magnetic conductive tray 10. Alternatively, a plane board 16 is overlaid on the guide channels to form a plane on the magnetic conductive tray 10.

The magnetizing conductor 20 is wound in a substantially Z-shaped path. The magnetizing conductor 20 starts from the guide channel 11 beside the first pair of projecting blocks 141 of the first magnetizing region 14 on upper side of front end of the magnetic conductive tray 10. Then the magnetizing conductor 20 is clockwise wound to the middle oblique guide channel 12 and transversely obliquely obviated by a pitch of the width of the longitudinal guide channel. Then the magnetizing conductor 20 is wound around the second pair of projecting blocks 152 of the second magnetizing region 15. Then the magnetizing conductor 20 is transversely counterclockwise obviated by the width of the guide channel and wound back to the other side of the first pair of projecting blocks 141 of the first magnetizing region 14 to form a polarity. Then the magnetizing conductor 20 is continuously sequentially wound around the projecting blocks in the above manner. Accordingly, the magnetizing conductor 20 is wound back and forth alternately in clockwise and counterclockwise directions. The magnetizing conductor 20 is wound from lower side of front end of the second pair of projecting blocks 142 of the first magnetizing region 14 to lower side of rear end of the third pair of projecting blocks 153 of the second magnetizing region 15. Accordingly, the magnetizing conductor 20 is wound back and forth to form a layout of reverse polarities in the first and second magnetizing regions 14, 15.

According to the above magnetic pole layout method and the magnetizing device, multiple pairs of corresponding first and second magnetizing regions 14, 15 with reverse magnetic poles can be directly formed on one single tray. Therefore, the magnetizable soft plate 30 can be quickly magnetized at one time to produce a soft magnet plate 30A with reverse magnetic poles. Accordingly, the production efficiency can be enhanced and the cost is lowered.

Figures 3, 4:
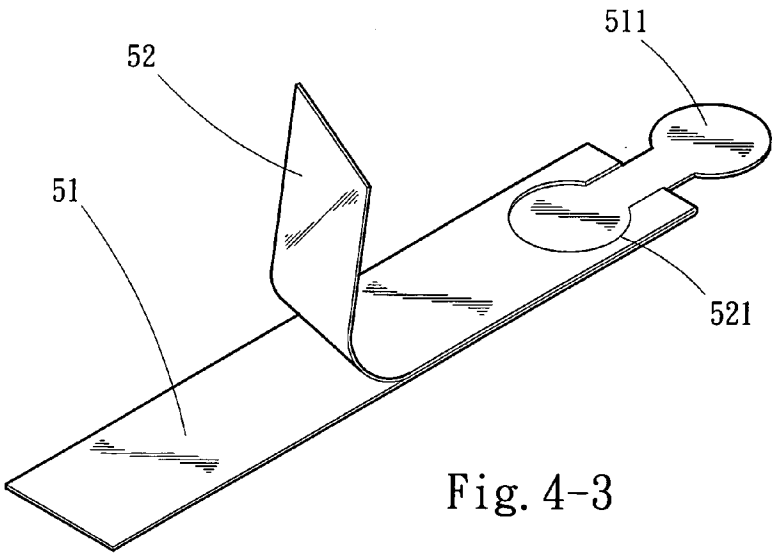
Figures 1, 4:
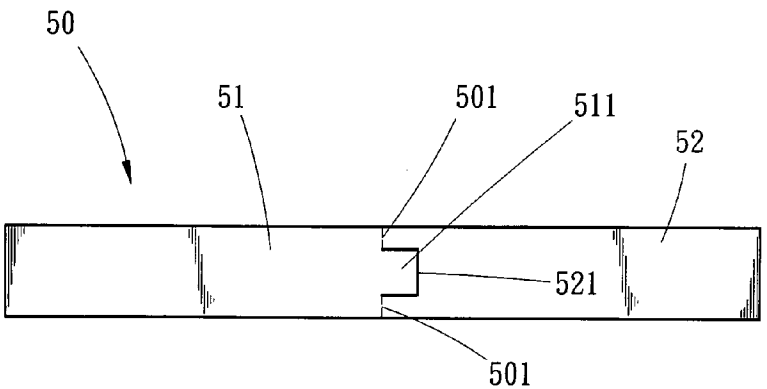
Figures 2, 4:
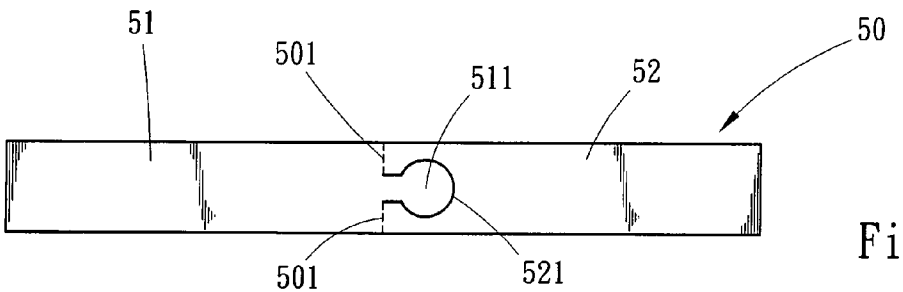
Figure 5:
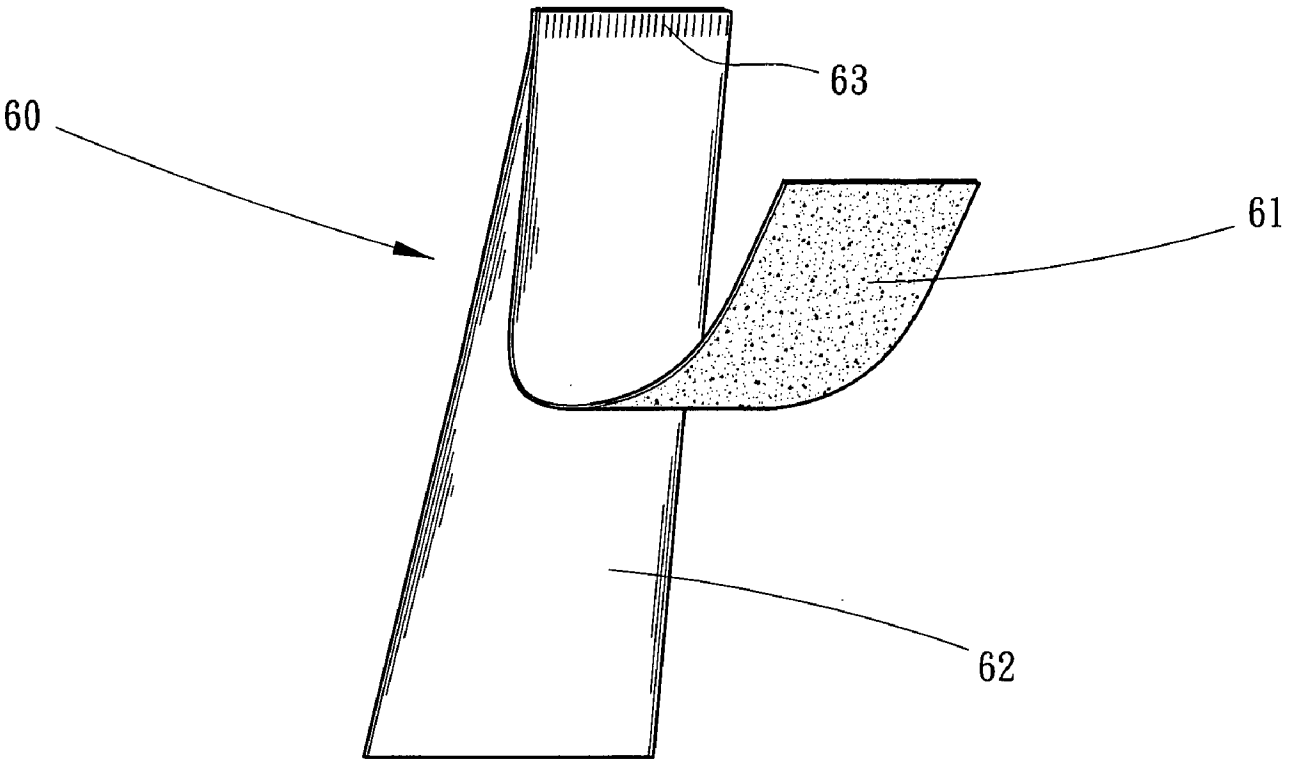
FIG. 5 is a perspective view of a conventional magnetic double-slat opposite attraction bookmark.

Referring to FIGS. 4-1 to 4-3, the double-wing opposite-attraction soft magnet of the present invention includes a double-wing opposite-attraction soft magnet slat 50. The soft magnet plate 30A produced by the magnetizing device is formed with a transverse folding line 501 along the oblique magnetic pole region 31 corresponding to the oblique guide channels 12. Then, according to the necessary width, in the direction of the magnetic poles, the soft magnet plate 30A is longitudinally cut into a slat with two foldable soft magnet wings 51, 52 with reverse magnetisms. The two soft magnet wings 51, 52 are interconnected by the folding line 501. In a preferred embodiment, at least one magnet wing 51 is cut with an extension tab 511 near the folding line 501 for a user to easily take the soft magnet slat 50 as shown in FIG. 4-1.

FIG. 4-2 shows that the extension tab 511 has a round profile. The other magnet wing 52 is formed with a complementary round recess 521. In addition, a paper-made or plastic film with decorative pictures can be disposed on the soft magnet slat 50. The decorative pictures can be embossed solid pictures or characters or plane pictures or characters. Also, the wings of the soft magnet slat can have equal length or unequal length as necessary.

Figure 6:
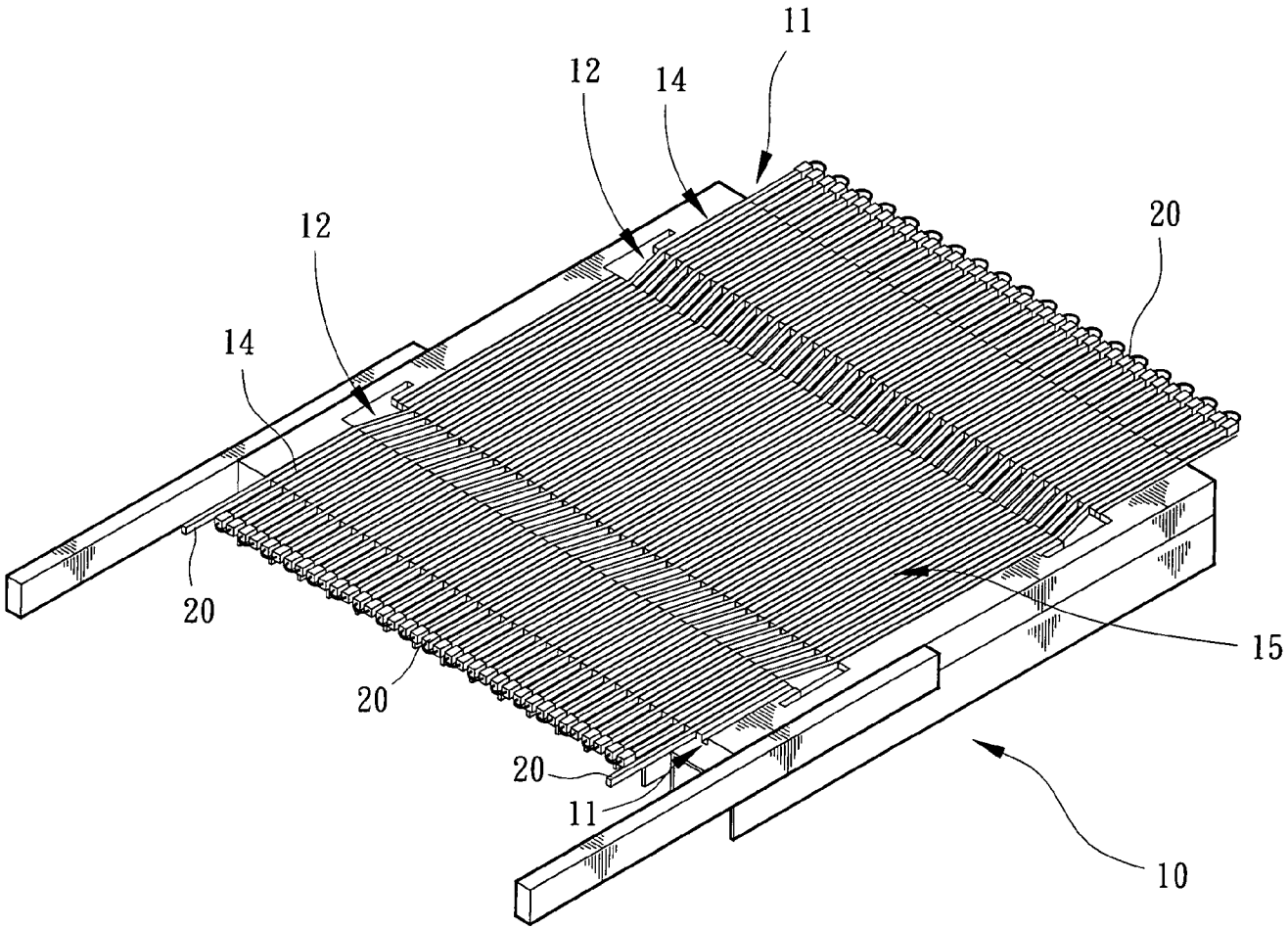
FIG. 6 is a perspective view of a second embodiment of the present invention, in which the magnetic tray is formed with two oblique guide channel regions for dividing the magnetic tray into multiple magnetizing regions.
Figure 7:
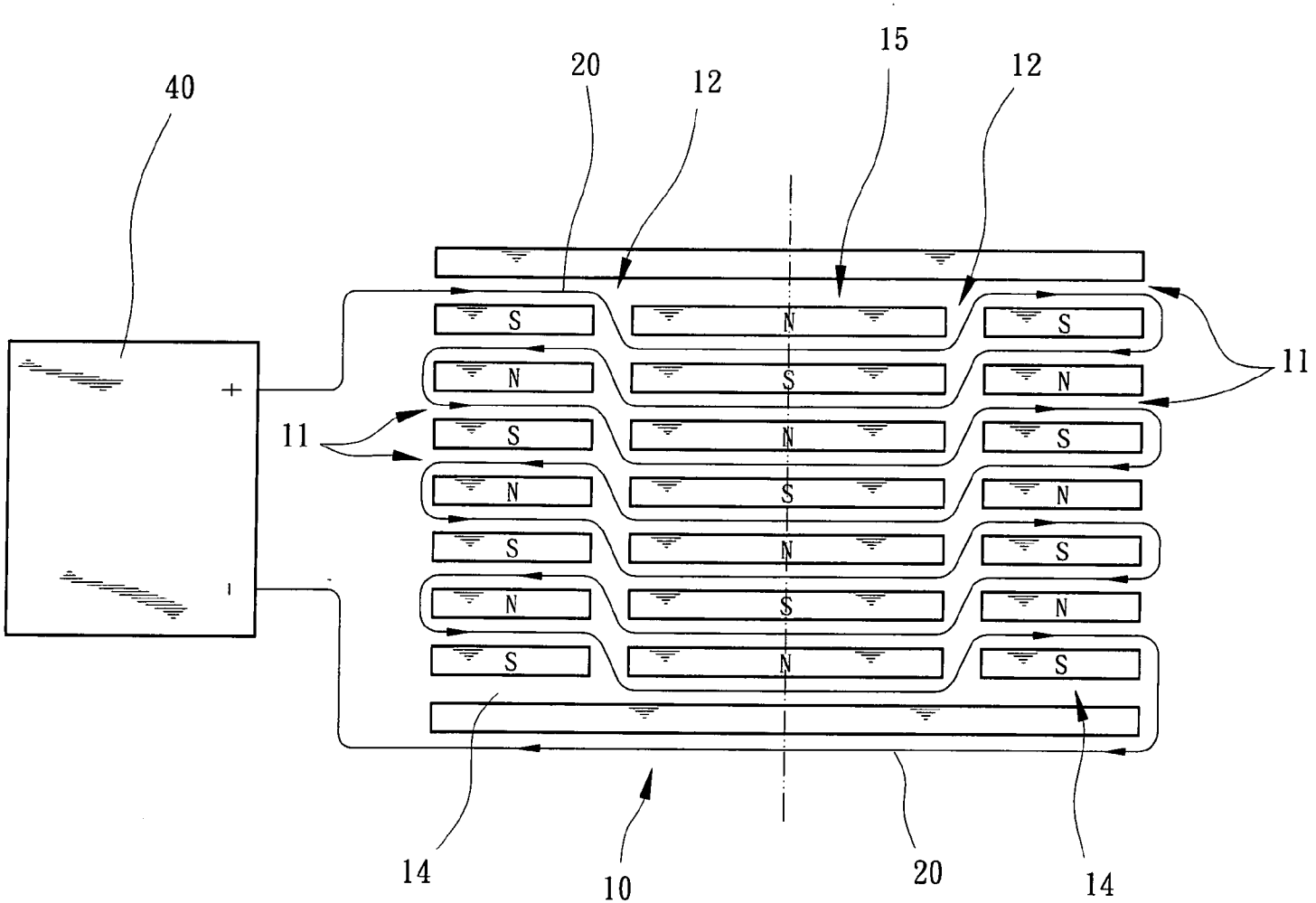
FIG. 7 is a top view according to FIG. 6, showing the magnetic pole layout method and the magnetizing device for the double-wing opposite attraction soft magnet of the present invention.
Figure 8:
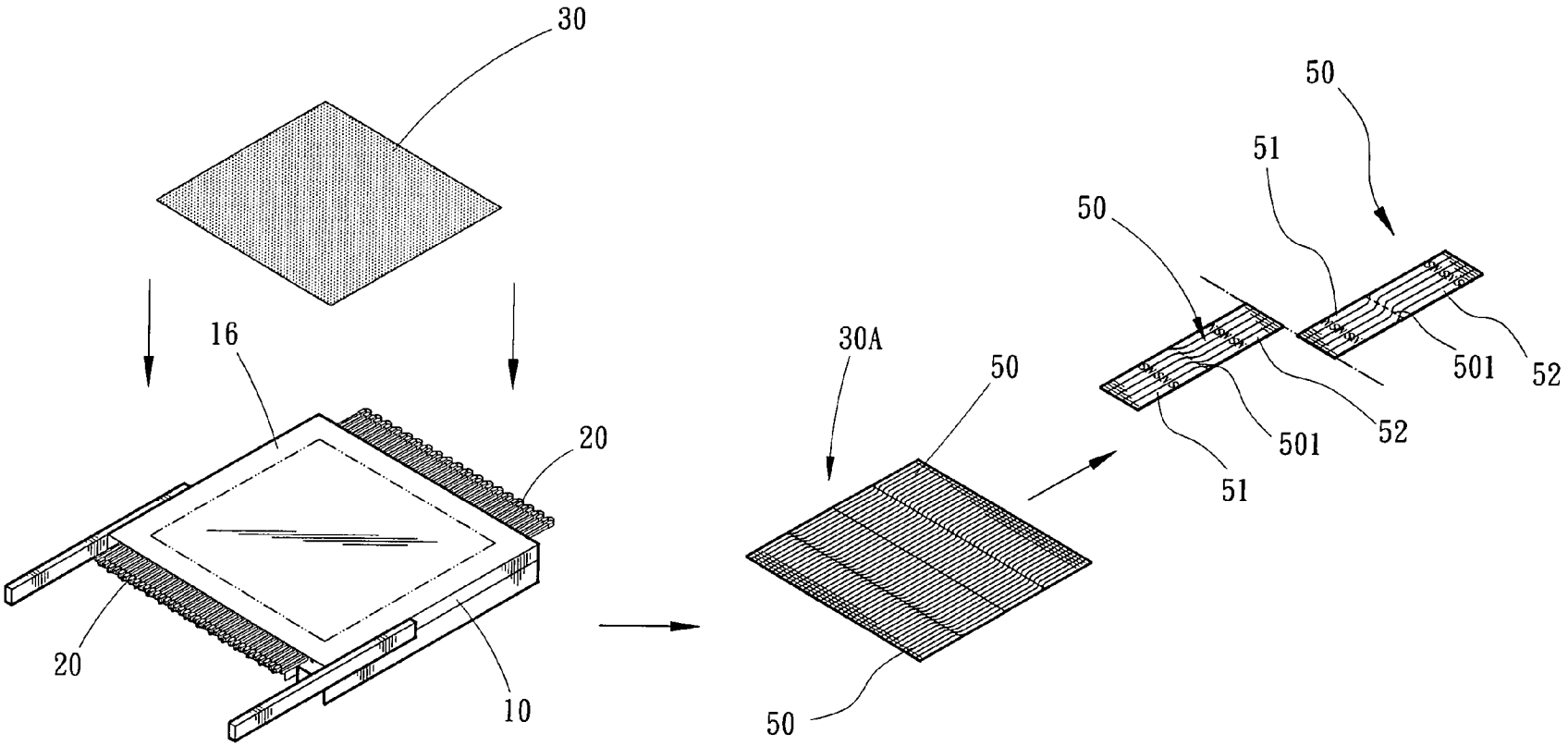
FIG. 8 is a perspective view showing the manufacturing procedure of the second embodiment of the present invention.

By means of the magnetic pole layout method and magnetizing device for double-wing opposite-attraction soft magnet of the present invention, the magnetizable soft plate can be magnetized at one time to produce multiple pairs of magnetic poles. After magnetized, the soft plate can be folded and the magnetic poles can attract each other. FIGS. 6 to 8 show a second embodiment of the present invention, in which the magnetic tray 10 is formed with at least two stages of back and forth oblique guide channels 12 for dividing the magnetic tray 10 into multiple magnetizing projecting block regions with reverse polarities. The circuit layout at the oblique guide channels 12 is back and forth obviated to form multiple stages of pairs of reverse magnetic pole regions at one time. Accordingly, multiple sets of double-wing opposite-attraction soft magnet plates can be produced at one time to enhance the production efficiency. The double-wing opposite-attraction soft magnet slat 50 can ride on a page of a book along the folding line 501 to clip the page. The extension tab 511 protrudes from the edge of the page to apparently mark the position of the page. Therefore, a reader can quickly turn to the page.

The above embodiments are only used to illustrate the present invention, not intended to limit the scope thereof. Many modifications of the above embodiments can be made without departing from the spirit of the present invention.

What is claimed is:

1. A magnetic pole layout method for double-wing opposite-attraction soft magnet, comprising steps of:

(a) preparing a magnetic conductive tray having multiple longitudinal guide channels and oblique guide channels for defining at least one pair of corresponding magnetizing regions;

(b) sequentially winding a magnetizing conductor on the corresponding magnetizing regions along the longitudinal guide channels and the oblique guide channels;

(c) horizontally placing a magnetizable soft plate on the magnetic conductive tray;

(d) feeding a pulse power to form reverse magnetic poles on the corresponding magnetizing regions for simultaneously magnetizing the magnetizable soft plate; and (e) cutting the magnetized soft plate into elongated slat in the direction of the formed magnetic poles and then transversely folding the elongated slat about a section magnetized by the oblique guide channels to form the double-wing opposite-attraction soft magnet.

2. The magnetic pole layout method for double-wing opposite-attraction soft magnet as claimed in claim 1, wherein in step (b), after sequentially winding the magnetizing conductor on the corresponding magnetizing regions along the longitudinal guide channels and the oblique guide channels, the guide channels are flush filled with bakelite powder or other insulating material to form a plane on the magnetic conductive tray.

3. The magnetic pole layout method for double-wing opposite-attraction soft magnet as claimed in claim 1, wherein in step (b), after sequentially winding the magnetizing conductor on the corresponding magnetizing regions along the longitudinal guide channels and the oblique guide channels, a plane board is overlaid on the guide channels to form a plane on the magnetic conductive tray.

4. The magnetic pole layout method for double-wing opposite-attraction soft magnet as claimed in claim 1, wherein the pulse power is supplied by a high-voltage or a high-current pulse power source.

5. The magnetic pole layout method for double-wing opposite-attraction soft magnet as claimed in claim 1, wherein the magnetizing conductor is wound in a substantially Z-shaped path, the magnetizing conductor being clockwise wound from a first pair of projecting blocks of a first magnetizing region on upper side of front end of the magnetic conductive tray to a middle oblique guide channel and then obliquely obviated by a pitch, then the magnetizing conductor being wound around a second pair of projecting blocks of a second magnetizing region, then the magnetizing conductor being transversely counterclockwise obviated by a pitch and then wound back to the lower side of front end of the first pair of projecting blocks of the first magnetizing region, then the magnetizing conductor being continuously sequentially wound around the projecting blocks in the above manner, whereby the magnetizing conductor is wound back and forth alternately in clockwise and counterclockwise directions, the magnetizing conductor being wound from lower side of front end of a second pair of projecting blocks of the first magnetizing region to lower side of rear end of a third pair of projecting blocks of the second magnetizing region, whereby the magnetizing conductor is wound back and forth to form a layout of multiple pairs of poles with reverse polarities in the first and second magnetizing regions.

6. A double-wing opposite-attraction soft magnet plate comprising a soft magnet slat having two foldable wings interconnected by a folding line, the two wings having opposite longitudinal multitrace reverse magnetic poles, whereby the wings can be oppositely folded to attract each other, near the folding line, the magnetic poles being both obliquely obviated by the width of one trace of the magnetic poles.

7. The double-wing opposite-attraction soft magnet plate as claimed in claim 6, wherein one of the wings is cut with a projecting extension tab at the folding line.

8. The double-wing opposite-attraction soft magnet plate as claimed in claim 6, wherein decorative pictures or characters are disposed on outer face of the soft magnet slat.

9. The double-wing opposite-attraction soft magnet plate as claimed in claim 8, wherein the decorative pictures are a paper-made or plastic film.

10. The double-wing opposite-attraction soft magnet plate as claimed in claim 6, wherein the wings of the soft magnet slat have unequal length.

11. The double-wing opposite-attraction soft magnet plate as claimed in claim 7, wherein the wings of the soft magnet slat have unequal length.

12. The double-wing opposite-attraction soft magnet plate as claimed in claim 8, wherein the wings of the soft magnet slat have unequal length.

13. The double-wing opposite-attraction soft magnet plate as claimed in claim 9, wherein the wings of the soft magnet slat have unequal length.

14. A magnetizing device for double-wing opposite-attraction soft magnet, comprising:

a magnetic conductive tray;

multiple longitudinal guide channels and oblique guide channels arranged on the magnetic conductive tray for together defining at least one pair of corresponding magnetizing regions;

a magnetizing conductor wound around the magnetizing regions, when wound to the oblique guide channels, the magnetizing conductor being obliquely obviated by a pitch of the width of one longitudinal guide channel; and a high-voltage or high-current pulse power source for forming reverse magnetic poles on the corresponding magnetizing regions to simultaneously magnetize a magnetizable soft plate.

15. The magnetizing device for double-wing opposite-attraction soft magnet as claimed in claim 14, wherein the longitudinal and oblique guide channels are filled with bakelite powder or other insulating material to form a plane on the magnetic conductive tray.

16. The magnetizing device for double-wing opposite-attraction soft magnet as claimed in claim 14, wherein the magnetizing conductor is wound in a substantially Z-shaped path.

17. The magnetizing device for double-wing opposite-attraction soft magnet as claimed in claim 15, wherein the magnetizing conductor is wound in a substantially Z-shaped path.

18. The magnetizing device for double-wing opposite-attraction soft magnet as claimed in claim 16, wherein the magnetizing conductor is clockwise wound from the guide channel on upper side of a first pair of projecting blocks of a first magnetizing region of front end of the magnetic conductive tray, then the magnetizing conductor being clockwise wound to a middle oblique guide channel and obliquely obviated by a pitch of the width of the longitudinal guide channel, then the magnetizing conductor being wound around a second pair of projecting blocks of a second magnetizing region, then the magnetizing conductor being transversely counterclockwise obviated by the width of the guide channel and wound back to lower side of front end of the first pair of projecting blocks of the first magnetizing region, then the magnetizing conductor being continuously sequentially wound around the projecting blocks in the above manner, whereby the magnetizing conductor is wound back and forth alternately in clockwise and counterclockwise directions, the magnetizing conductor being further wound from lower side of front end of a second pair of projecting blocks of the first magnetizing region to lower side of rear end of a third pair of projecting blocks of the second magnetizing region, whereby the magnetizing conductor is wound back and forth to form a layout of reverse polarities in the first and second magnetizing regions.

19. The magnetizing device for double-wing opposite-attraction soft magnet as claimed in claim 17, wherein the magnetizing conductor is clockwise wound from the guide channel on upper side of a first pair of projecting blocks of a first magnetizing region of front end of the magnetic conductive tray, then the magnetizing conductor being clockwise wound to a middle oblique guide channel and obliquely obviated by a pitch of the width of the longitudinal guide channel, then the magnetizing conductor being wound around a second pair of projecting blocks of a second magnetizing region, then the magnetizing conductor being transversely counterclockwise obviated by the width of the guide channel and wound back to lower side of front end of the first pair of projecting blocks of the first magnetizing region, then the magnetizing conductor being continuously sequentially wound around the projecting blocks in the above manner, whereby the magnetizing conductor is wound back and forth alternately in clockwise and counterclockwise directions, the magnetizing conductor being further wound from lower side of front end of a second pair of projecting blocks of the first magnetizing region to lower side of rear end of a third pair of projecting blocks of the second magnetizing region, whereby the magnetizing conductor is wound back and forth to form a layout of reverse polarities in the first and second magnetizing regions.

* * * * *